United States Patent [19]

Hall

[11] 4,194,532

[45] Mar. 25, 1980

[54] CONTROL VALVE WITH BYPASS MEANS

[75] Inventor: Lowell R. Hall, Elwood, Ill.

[73] Assignee: Caterpillar Tractor Co., Peoria, Ill.

[21] Appl. No.: 895,211

[22] Filed: Apr. 10, 1978

[51] Int. Cl.[2] ..... F158 13/042

[52] U.S. Cl. ..... 137/596; 91/447; 91/451; 91/454

[58] Field of Search ..... 137/596; 91/447, 451, 91/468, 464, 457, 445

[56] References Cited

U.S. PATENT DOCUMENTS

| | | | |
|---|---|---|---|
| 2,554,930 | 5/1951 | Ulinski | 91/445 |
| 2,644,429 | 7/1963 | Waterman et al. | 91/445 |
| 3,136,226 | 6/1964 | Gratzmuller | 91/447 X |
| 3,439,583 | 4/1969 | Stacey | 91/447 X |
| 3,654,835 | 4/1972 | Stevenpiper | 137/596 X |
| 3,818,802 | 6/1974 | Wilson | 91/443 |
| 3,902,401 | 9/1975 | Allen et al. | 91/451 X |
| 3,906,838 | 9/1975 | Hofer | 91/461 X |

*Primary Examiner*—Irwin C. Cohen
*Attorney, Agent, or Firm*—John W. Grant

[57] ABSTRACT

A valve controls fluid flow to a fluid jack by movement of a single valve spool to a first position. A check valve and bypass valve cooperate to pass fluid exhausted from the fluid jack to a tank bypassing the single valve spool. Movement of the bypass valve is controlled by developing a controlled pressure drop between the fluid in the fluid jack and the fluid between the check valve and the single valve spool in response to the valve spool being moved to a second position.

2 Claims, 1 Drawing Figure

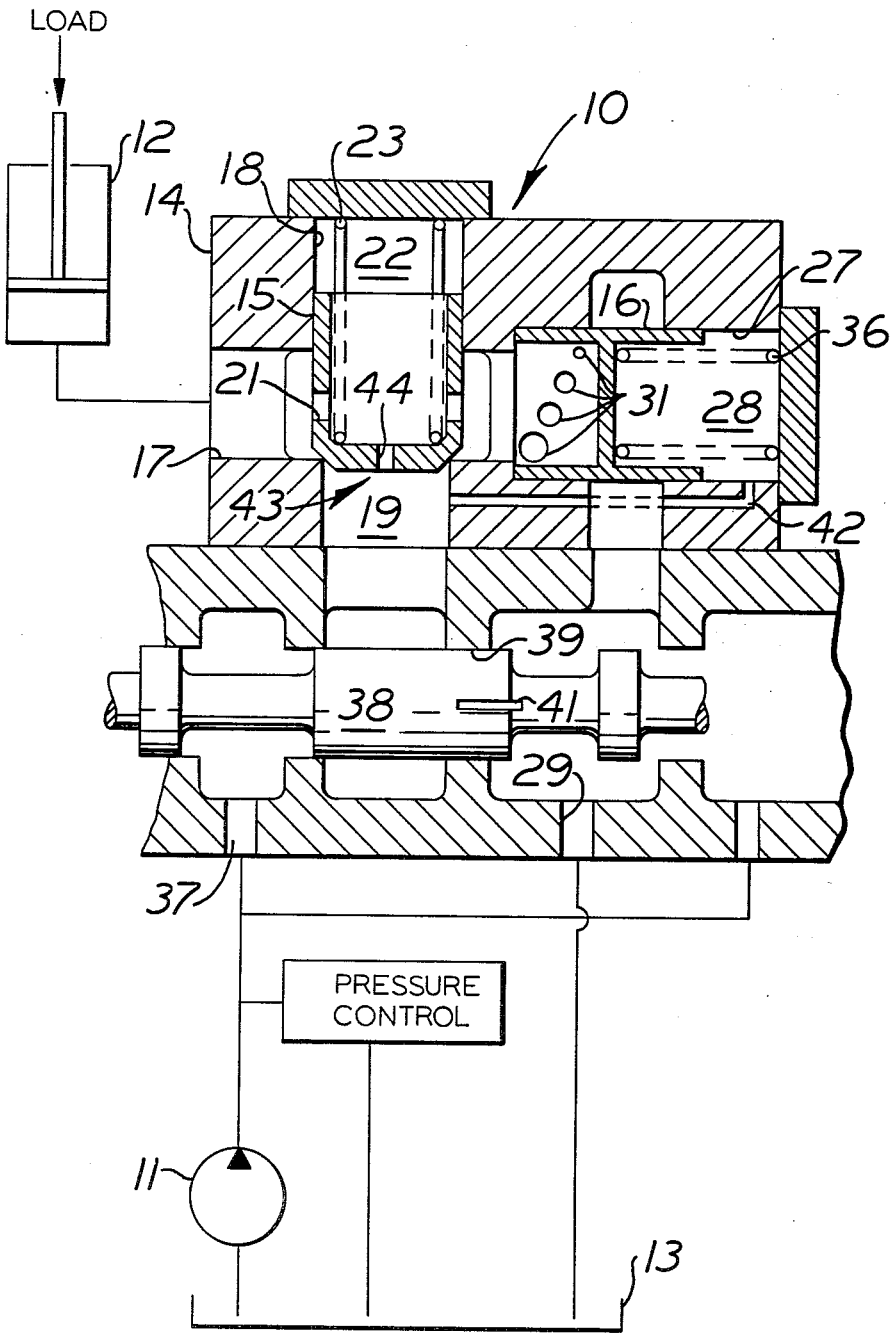
LOAD
12
10
23
18
14
22
27
15
16
36
21
44
31
28
17
43
19
42
39
38
41
29
37
PRESSURE CONTROL
11
13

CONTROL VALVE WITH BYPASS MEANS

BACKGROUND OF THE INVENTION

This invention relates to a control valve and more particularly to a control valve having a bypass valve for bypassing load generated pressurized fluid around a valve spool.

In many hydraulic systems, one or more hydraulic jacks are employed to raise and lower a heavy load. Such heavy loads generate high fluid pressure in the hydraulic jacks. When the control valve is shifted to lower the load, the pressurized fluid exhausted from the jack passing through the control valve generates high flow forces on the valve spool. The high flow forces are particularly troublesome when the operator is modulating the valve to control the rate of lowering. In some cases, the flow forces can impair the operator's capability of modulating the fluid flow exhausted from the hydraulic jacks.

One solution to the problem of metering fluid exhausted from a hydraulic jack employs a check valve and a fluid discharge valve for passing the exhausted fluid directly to a drain port thereby bypassing the main valve spool. However, that valve arrangement employs a second valve spool positioned remote from the main valve spool for controlling the opening of the fluid discharge valve. The addition of a second valve spool for controlling the discharge valve not only adds cost to the manufacturing of the valve arrangement, but also adds to the complexity of the valve arrangement since other controls must be provided to coordinate the movement of the main valve spool and the second valve spool.

SUMMARY OF THE INVENTION

The present invention is directed to overcoming one or more of the problems as set forth above.

According to the present invention, this is accomplished by providing a valve having a check valve movable between a first position at which fluid is free to flow from a passage to a fluid jack and a second position at which reverse fluid flow from the fluid jack to the passage is substantially blocked. A bypass valve is movable between a first position at which fluid flow between the fluid jack and a drain port is blocked and a second position at which the fluid jack is in communication with the drain port. A single valve spool is movable between a first position at which an inlet port is in communication with the passage and a second position at which the passage is in communication with the drain port. A passage means connects a fluid chamber at one end of the bypass valve to the passage. An orifice means provides restricted communication between the motor port and the passage at the second position of the check valve and develops a controlled pressure drop between the motor port and the passage and hence the fluid chamber in response to the valve spool being moved to the second position.

BRIEF DESCRIPTION OF THE DRAWING

The sole FIGURE is a diagrammatic sectional view of a valve of the present invention.

DETAILED DESCRIPTION

Referring now to the drawing, a control valve 10 controls fluid flow from a pump 11 to a fluid jack 12 and fluid exhausted from the fluid jack to a tank 13. Control valves as are known in the art generally have a valve body 14, a check valve 15 and a bypass valve 16. The valve body 14 has a motor port 17 connected to the fluid jack. The check valve 15 is slidably positioned within a bore 18 and is movable between a first position at which fluid is free to flow from a passage 19 to motor port 17 and a second position at which reverse fluid flow from the motor port to passage 19 is substantially blocked. A pair of ports 21 in check valve 15 communicate the motor port with a chamber 22 at the back side of the check valve. The check valve is resiliently urged to the second position by a spring 23 and is moved to the first position in response to the fluid pressure in passage 19 exceeding the fluid pressure in the motor port sufficiently to overcome the bias of spring 23.

The bypass valve 16 is slidably positioned within a bore 27 forming a chamber 28 at one end thereof. The bypass valve is movable between a first position at which fluid flow from motor port 17 to a drain port 29 is blocked and a second position at which the motor port is in communication with the drain port through a plurality of ports 31, in the bypass valve. The ports are preferably staggered and are of different size so that fluid flow from the motor port to drain port 29 can be modulated dependent upon the amount of movement of the bypass valve 16. The bypass valve is resiliently urged to the first position by a spring 36 and to the second position in response to the fluid pressure in the motor port exceeding the fluid pressure in the chamber 28 sufficiently to overcome the bias of spring 36.

The valve body 14 has an inlet port 37 connected to pump 11. A single valve spool, a portion of which is shown 38, is slidably positioned within a bore 39 and is movable between a first position at which inlet port 37 is in communication with passage 19 and a second position at which passage 19 is in communication with drain port 29. The passage 19 is blocked from the drain port at the first position of the valve spool 38 and is blocked from the inlet port at the second position of the valve spool. The valve spool has an intermediate position at which the passage is blocked from both the inlet and drain ports. The position of the valve spool is controlled by an operator through suitable linkage and lever means, not shown.

A metering slot 41 is provided in valve spool 38 for metering fluid flow from passage 19 to drain port 29 at the second position of the valve spool.

A passage means, for example a passage 42 in valve body 14 connects the fluid chamber 28 with passage 19.

An orifice means 43 provides restricted communication between motor port 17 and passage 19 at the second position of check valve 15 and develops a pressure drop between the motor port and the passage in response to the valve spool 38 being moved to the second position. With fluid chamber 28 being connected to the passage 19 through the passage 42, the fluid pressure in fluid chamber 28 is always substantially the same as the fluid pressure in passage 19. Thus, when the fluid pressure in passage 19 drops below the fluid pressure in motor port 17, the fluid pressure in fluid chamber 28 is also less than the fluid pressure in the motor port.

The orifice means 43 can be, for example, the ports 21 in check valve 15 and an orifice 44 in the check valve.

OPERATION

In operation, raising the load is initiated by the operator moving valve spool 38 to the right as viewed in the drawing to the first position. Fluid from pump 11 unseats check valve 15 and is directed to the fluid jack 12. When the load reaches the desired position, the operator returns the valve spool to the intermediate position. Thus, with passage 19 blocked from both inlet port 37 and drain port 29, the fluid pressure in motor port 17 and passage 19 equalizes, resulting in the check valve being moved to its second or closed position by spring 23.

Lowering the load is initiated by the operator moving valve spool 38 to the left as viewed in the drawing to the second position. With passage 19 connected to the drain port 29, a pressure drop is developed across orifice 44 so that fluid pressure in the passage 19, and hence fluid chamber 28, is less than the fluid pressure in motor port 17 resulting in the bypass valve 16 being moved rightwardly to the second position to obtain a force balance on the bypass valve. At the second position of the bypass valve, fluid passes from the motor port through ports 31 and drain port 29 to the tank. The pressure differential between the motor port 17 and the passage 19 and hence the amount of movement of bypass valve 16 can be precisely controlled by the operator. This is accomplished by controlling the position of spool 38 for metering fluid flow from passage 19 to the drain port 29 through the metering slots 41 in valve spool 38.

When the load is lowered to the desired position, the operator returns the valve spool 38 to the intermediate position causing the fluid pressure in passage 19, chamber 28 and motor port 17 to equalize, resulting in bypass valve 16 being moved to its first position blocking fluid flow from the motor port to the drain port.

It is to be understood that only those portions of the valve spool 38 and valve body 14 necessary for an understanding of the present invention are shown in the drawing. However, as is known in the art, the valve body and valve spool can include means for directing fluid from the pump 11 to the rod end of the fluid jack 12 at the second position of the valve spool.

In view of the above, it is readily apparent that the structure of the present invention provides an improved control valve in which the fluid flow forces action on the valve spool during the lowerng of a gravity load are reduced. This is accomplished by utilizing a bypass valve in conjunction with a check valve for controllably passing the fluid exhausted from the fluid jack directly to the tank bypassing the valve spool. Thus, when lowering the load, the valve spool is used only for controlling the small amount of fluid passing through the orifice. By utilizing a single valve spool for controlling both the fluid flow to the fluid jack during raising the load and the fluid passing through the orifice during lowering the load, the complexity and cost of the control valve is reduced.

Other aspects, objects and advantages of this invention can be obtained from a study of the drawing, the disclosure and the appended claims.

The embodiments of the invention in which an exclusive property or privilege is claimed are defined as follows:

1. In a control valve for controlling fluid directed to and exhausted from a fluid jack, said control valve having a motor port connectable to the hydraulic jack, a passage, a check valve positioned between the passage and the motor port and being movable between a first position at which fluid is free to flow from the passage to the motor port and a second position at which reverse fluid flow from the motor port to the passage is substantially blocked, a drain port, a bypass valve positioned between the motor port and the drain port and being movable between a first position at which fluid flow between the motor port and the drain port is blocked and a second position at which the motor port is in communication with the drain port independent of said passage, a fluid chamber positioned at one end of the bypass valve, and an inlet port; the improvement comprising:

passage means for connecting the fluid chamber to the passage;

orifice means for restricting communication between the motor port and the passage at the second position of the check valve and developing a pressure drop between the motor port and the passage, and hence between the motor port and the fluid chamber in response to the passage being communicated with the drain port; and a single valve positioned between the passage and both the inlet and drain ports and being movable between a first position at which the inlet port is in communication with the passage and a second position at which the passage is in communication with the drain port and the pressure drop between the motor port and the passage is precisely controlled by controllably modulating from the passage only the fluid entering the passage through the orifice means.

2. The control valve of claim 1 including a second chamber at one end of the check valve, said orifice means including a port connecting the motor port with the second chamber and an orifice connecting the second chamber with the passage.

* * * * *